US007461747B2

(12) United States Patent
Razzaboni et al.

(10) Patent No.: US 7,461,747 B2
(45) Date of Patent: Dec. 9, 2008

(54) MACHINE FOR THE ORDERLY STORAGE AND DELIVERY OF BANKNOTES

(75) Inventors: Vittorio Razzaboni, Mirandola (IT); Nicoletta Razzaboni, Mirandola (IT)

(73) Assignee: Cima S.p.A. di Razzaboni & Co. (IT)

( * ) Notice: Subject to any disclaimer, the term of this patent is extended or adjusted under 35 U.S.C. 154(b) by 314 days.

(21) Appl. No.: 10/547,926

(22) PCT Filed: Mar. 8, 2004

(86) PCT No.: PCT/EP2004/002345

§ 371 (c)(1),
(2), (4) Date: Sep. 8, 2005

(87) PCT Pub. No.: WO2004/081888

PCT Pub. Date: Sep. 23, 2004

(65) Prior Publication Data

US 2006/0169623 A1 Aug. 3, 2006

(30) Foreign Application Priority Data

Mar. 11, 2003 (IT) ..... MI2003A0454

(51) Int. Cl.
*G07F 7/04* (2006.01)
*B07C 5/00* (2006.01)

(52) U.S. Cl. ..... 209/534; 194/206; 194/207

(58) Field of Classification Search ..... 209/534; 194/206, 207; 902/12, 13
See application file for complete search history.

(56) References Cited

U.S. PATENT DOCUMENTS 6,371,473 B1 * 4/2002 Saltsov et al. ..... 271/3.01
6,598,726 B1 * 7/2003 Lundblad et al. ..... 194/206

FOREIGN PATENT DOCUMENTS

EP 795842 A2 * 9/1997

* cited by examiner

*Primary Examiner*—Joseph C Rodriguez
(74) *Attorney, Agent, or Firm*—Shlesinger Fitzsimmon

(57) ABSTRACT

A machine for the orderly storage and delivery of banknotes comprises an input of banknotes (11), an output of banknotes (19), a path (12, 14, 15, 18) of sequential flow of banknotes between the input and the output, devices (13) for detecting the characteristics of the banknotes along said path and a plurality of compartments (20) for the internal storage of the banknotes. Each compartment (20) of the plurality is a sequential drum compartment and winding belts and the compartments of the plurality are divided into two series of compartments (16, 17). The internal path of the banknotes between input and output comprises a sorting section (15) along which the inputs/outputs of the two series of compartments of the plurality face each other alternately on two opposite sides, each input/output being associated to sorting means (25) that can be commanded for the deviation of the banknotes between the sorting path (15) and the compartment (20) associated.

13 Claims, 2 Drawing Sheets

MACHINE FOR THE ORDERLY STORAGE AND DELIVERY OF BANKNOTES

The present invention refers to a machine for the orderly storage and delivery of banknotes, for example of the type used as an aid by a bank teller. In particular a machine of the type using compartments with winding belts of the banknotes on drums is described.

Machines of this type are generally known. The known machines though have structures that cannot reconcile the conflicting needs for compartments of high capacity, high storage speed and delivery of the banknotes and, especially in the case of high operation speeds, high reliability both in mechanical operating without jamming and in the safe and rapid identification, rejection and/or separate storage of the banknotes that are not considered suitable by the internal system for detecting the characteristics of the banknotes inserted.

The general aim of the present invention is to obviate the above-mentioned inconveniences by supplying a machine of the said type that amongst other things achieves at the same time high storage capacity, high operation speed and high reliability.

In view of this aim we considered making, according to the invention, a machine for the orderly storage and delivery of banknotes comprising an input of banknotes, an output of banknotes, a path of sequential flow of banknotes between the input and the output, devices for detecting characteristics of the banknotes along said path and a plurality of compartments for internal storage of the banknotes, characterized in that each compartment of the plurality is a sequential drum compartment and winding belts, the compartments of the plurality are divided into two series of compartments and the said internal path of the banknotes between input and output comprises a sorting section along which the inputs/outputs of the two series of compartments of the plurality face each other alternately on two opposite sides, each input/output being associated to sorting means that can be commanded for the deviation of the banknotes between the sorting path and the compartment associated.

To make even clearer the explanation of the innovative principles of the present invention and its advantages in comparison with the known technique herein below follows the description of an embodiment thereof applying said principles with the aid of enclosed drawings. In the drawings.

Figure 1:
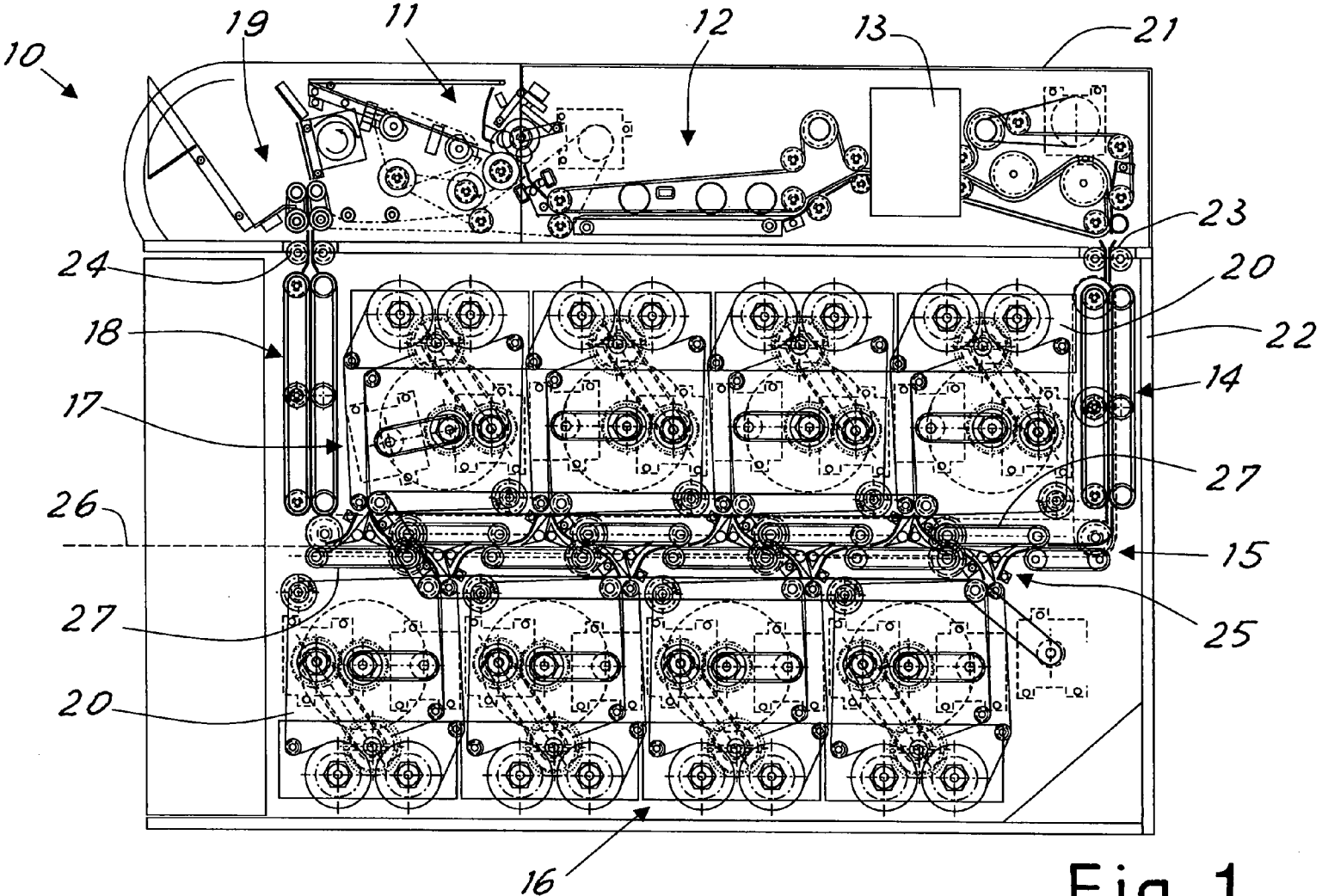
FIG. 1 represents a schematic view in side elevation of a machine according to the invention.

With reference to the figures, FIG. 1 shows a schematic view in a side elevation of the machine according to the invention. The machine, indicated in general terms with 10, comprises a motorized tray 11 for the input of the banknotes whose purpose is to receive a pack of banknotes to be checked and stored. The tray 11 feeds the banknotes to a known sequencer device 12, which sends the banknotes in sequence, spaced out one from the other, by means of suitable rollers and flow belts. After the sequencer device 12, a known checking device 13 is placed along the path of the banknotes which checks the characteristics of the banknotes. Generally the control is needed to verify the authenticity of the banknotes themselves.

When the banknotes leave the checking device they reach a downward path 14 with parallel facing belts that carries the banknotes to a path or horizontal section 15 of distribution or sorting that flows between two series 16, 17 of overlapped sequential compartments. At the other end of the sorting path

15 there is an upward path 18 with parallel facing belts, which ends in line with an output tray 19. The path is basically a circular path so as to have input and output close to each other.

As will be seen below the two series of compartments are composed of a certain number of compartments 20 basically identical to each other. In the preferred embodiment two series of four compartments each one are used.

Advantageously, the machine is divided into an upper head 21 that lies on a compartment body 22. The upper head comprises the trays of input and output 11, 19, the sequencer device 12 and the checking device 13, while the compartment body comprises the compartments 20, the downward and upward paths and the horizontal distribution path, with all the relative accessories. The upper head and the compartment body have relative paths of the banknotes that communicate in only two points of input/output 23, 24. In this manner, it is easy to be able to make the compartment body armored, while the upper head is easily accessible for maintenance. In addition, in case of necessity it is easy to position the head relatively further from the compartment body, by means of additional conveying paths. The head is also easily replaceable in case of malfunctioning. The input/output points 23, 24 are advantageously positioned near opposite ends of the head part, made horizontally elongated to have basically horizontal paths.

As can be seen well in FIG. 1, it has been found particularly advantageous to make the two series of compartments staggered, with devices or means 25 of input and output from each compartment of a series that are positioned in alternation along the path 15 with the devices or means of input and output 25 of the compartments of the other series.

Again advantageously, this has been achieved by positioning conveyor belts 27 alternately on two sides of a surface 26 for the flow of the banknotes along the path 15. The belts on each side of the surface 26 are alternated with the means 25 of input and output from the compartments 20 and the end of a belt on one side of the surface coincides basically with the beginning of a successive belt on the other side of the surface. Between one sorting means and the next of a same series a conveyor belt is thus present that faces (above or below according to the case) a sorting means of a compartment of the other series.

In this manner, the input and output means 25 and the belts 27 make a substantial continuity of the distribution path 15 between the two downward and upward branches 14 and 18. The belts 27 can be motorized by means of a belt transmission 47 in common.

Figure 2:
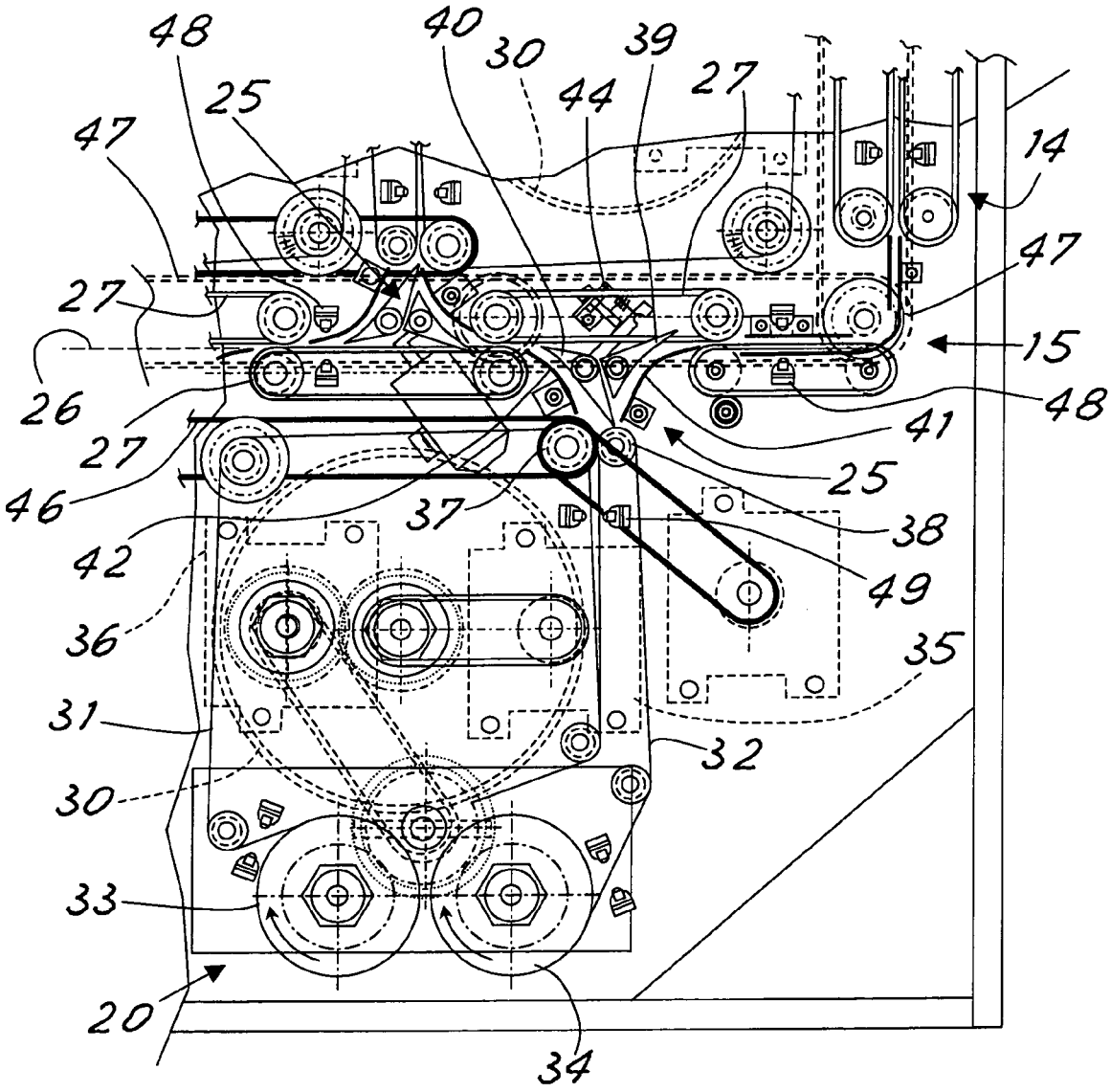
FIG. 2 represents an enlarged schematic view of details of the machine of FIG. 1.

FIG. 2 shows more in particular the structure of a compartment 20 and of the input and output means 25 with the relative conveyor belts 27 upstream and downstream of these means.

Each compartment 20 comprises a motorized drum 30 for winding a couple of film tapes 31, 32 that are unwound from feeding reels 33, 34. By means of return rollers 37, 38 the tapes are brought near each other to be wound on the drum 30 with the banknotes interposed and conveyed to the compartment.

During the banknote receiving movement the drum is moved by a motor 35 while the reels of the tapes are idle. During the opposite movement of returning the banknotes the drum is left idle and is drawn in rotation by the rewinding of the tapes on the reels, motorized in a synchronized manner by means of a motor 36.

Advantageously, a roller 37 of each couple of return rollers 37, 38 is motorized. For example, all the rollers 37 can be motorized by means of a belt transmission 46 in common.

The means 25 of input and output that suitably convey the banknotes are present in line with the return rollers 37, 38.

These means 25 advantageously comprise a couple of blades or deviators 39, 40, each one fronted by a respective slide 41, 42 to form a corresponding path of input to the compartment between deviator 39 and slide 41 and a corresponding output path from the compartment between deviator 40 and slide 42.

As can be seen well again in FIG. 1, the input deviator 39 is advantageously actionable by means of an actuator 45 (for example a solenoid) to move between a position of interception of a banknote that flows along the path 15 to deviate it towards the respective compartment, and a position of non-interception of the banknote to permit its passage along the path 15 without deviation.

The two positions are respectively shown with a continuous line and with a dotted line for the first deviator on the right in FIG. 2.

The output deviator 40 can be kept in the position shown (which is for sending a banknote from the compartment towards the path 15) by means of elastic elements 44, so as to yield elastically and not constitute an obstacle to the passage of a banknote that reaches the compartment from the input path or that transits on the path 15 direct towards the successive compartments.

For greater clarity of drawing, the elastic means 44 are shown only for the first input deviator, while the actuator 45 is only shown for the second output deviator.

An optical sensor 48 for detecting the passage of a banknote is present on the path of the banknotes before each deviation group 25, so as to be able to synchronize the activation of the deviation means with the movement of the banknotes. As shown in FIG. 2, only one sensor 48 can be provided for each couple of upper and lower compartments near each other.

Optical sensors 49 can also be provided for to detect the input and output of a banknote between the belts of each compartment.

To use the machine, one or more banknotes (on top of each other) are placed on the input tray 11 and the machine is started up for storage. The tray feeds the banknotes one at a time to the device 12 where they are suitably spaced out to and then passed through the checking device 13.

The checking device controls the acceptability of each banknote and recognizes the denomination of the banknote itself. As the banknotes flow and are stored sequentially in the machine, the information detected by the checking device can be associated without error to each banknote for the entire time it spends in the machine.

After being checked the banknotes enter the lower body of the machine and reach the beginning of the horizontal sorting path 15. Thanks to the fact that between the checking device and the sorting section the vertical section 14 is present, the checking device can terminate the processing of the information acquired during transit of the banknote before the banknote is treated again in the sorting path. Even though the banknotes flow at high speeds the information needed for the correct treatment is thus certainly available before it is necessary to start the treatment.

When a banknote reaches the beginning of the sorting path 15 the machine already has the information to decide if the banknote has to be refused or accepted and in which compartment it should be stored, for example according to the denomination.

The banknote flows along the sorting path 15 and is deviated by the suitable means 25 towards the pre-selected compartment. After reaching the compartment it is incorporated between the tapes that wind on the accumulation drum of the compartment.

Should the banknote be refused (for example because it is false) it can proceed to the end of the sorting path and go back along the path 18 up to the output tray. Alternatively, one of the compartments can be set up to store the banknotes that are not acceptable.

In a second operating method, the banknotes that reach the beginning of the sorting path are all inserted sequentially into the first compartment. Once these banknotes have been declared storable they are removed from the first compartment and sorted along the path 15 to reach the correct compartment of destination. The first compartment is therefore a temporary accumulation compartment. This has proved to be particularly useful for preventing the banknotes from entering the definitive compartments before additional operations are carried out, such as the acceptance by the operator of the total amount that the machine detects and visualizes. In this manner, the machine can return the banknotes inserted to the output, with only one loading operation, without them being mixed with the other banknotes that are already in the machine or that anyway come into contact with the other banknotes already in the machine or with the final compartments. In addition, the final sorting phases can be carried out during the pauses or the dead periods between phases of banknote input/output. This lead to a further increase of the speed with which the banknotes are inserted into the machine. When the dispensing of a certain amount is requested, with the indication or not of the denominations desired, the machine withdraws sequentially the various banknotes from the various compartments and delivers them onto the output tray 19, suited for receiving a certain quantity of them, in a pile.

At this point it is clear how the preset aims are achieved, by supplying a machine of strong and efficient structure, that ensures high operative speeds and high reliability. The machine is very flexible in its operations and can very easily temporarily store all the types of banknotes in only one compartment and then sort them out to the others, dividing the banknotes in different compartments according to the denomination, using several compartments for the same denomination or the same compartment for several denominations, or also a combination of all these possibilities.

The fact that the banknotes, except in the compartments, always circulate in the same direction between input and output of the machine permits the simplification of the paths and increases the reliability of the machine. Naturally, the description made above of an embodiment applying the innovative principles of the present invention is given as an example of these innovative principles and therefore must not be taken as limiting within the sphere of patent right herein claimed. For example, the machine can also comprise further known sensors for detecting the position or the characteristics of the banknotes in it, systems for protecting against tampering, devices for marking the banknotes, etc.

The invention claimed is:

1. A machine for the orderly storage and delivery of banknotes comprising:

an input of banknotes;

an output of banknotes;

an internal path for banknotes flowing between the input of banknotes and the output of banknotes;

a plurality of compartments for internal storage of the banknotes, with each compartment of the plurality being a sequential compartment having drum and winding belts, the compartments of the plurality being divided into two series of compartments having respective compartment inputs/outputs facing each other alternately on two opposite sides of a sorting section of said internal path of banknotes, each compartment input/output being associated to sorting means that can be commanded for the deviation of the banknotes between the sorting path and the associated compartment; and wherein said internal path is a unidirectional path for sequential circulation of the banknotes in the same direction from the input of banknotes to the output of banknotes, devices for detecting the characteristics of the banknotes being present along said internal path between in the input of banknotes and the sorting section.

2. The machine according to claim 1 wherein the path is a basically circular path to have input and output near.

3. The machine according to claim 1, in wherein the sorting section is basically horizontal with the compartments of the series positioned above the sorting section and the compartments of the other series positioned below the sorting section.

4. The machine according to claim 3, wherein the two series of compartments are staggered, with the sorting means associated to each compartment of the series that are positioned in alternation along the sorting section with the sorting means associated to the compartments of the other series and between one sorting means and the next of the same series being present a conveyor belt that faces a sorting means of a compartment of the other series.

5. The machine according to claim 1, wherein the sorting means comprises an input deviator which is mobile on command between a non-operative position of free passage of a banknote along the sorting section and an operation position in which it intercepts the path of a banknote in the sorting section and deviates it towards the input of the corresponding compartment.

6. The machine according to claim 1, wherein the sorting means comprises an output deviator that directs a banknote in output from the corresponding compartment towards the sorting section downstream and that is elastically mobile to permit the free passage of a banknote along the corresponding sorting section.

7. The machine according to claim 1, wherein the input and the output and the devices for detecting the characteristics of the banknotes are contained in a head part of the machine positioned above a body part of the machine that contains the compartments and the said sorting section.

8. The machine according to claim 7, wherein the head part and the body part are separable from each other.

9. The machine according to claim 7, wherein the head part and the body part exchange banknotes through two passages respectively of input and output of the banknotes from the body part and that are positioned near the opposite ends of the head part made elongated horizontally.

10. The machine according to claim 9, wherein the body part comprises a first path for conveying banknotes basically vertical between input passage and beginning of the sorting section and a second path for conveying banknotes basically vertical between the end of the sorting section and output passage.

11. The machine according to claim 1, wherein the first compartment along the sorting section is a temporary compartment that temporarily receives the banknotes from the input that are destined to be then sent to the other compartments of the plurality.

12. The machine according to claim 11, wherein the banknotes are extracted from the temporary compartment after checking the condition of acceptance or non acceptance of them to be sent respectively to the other compartments or towards the output.

13. A machine for the orderly storage and delivery of banknotes, comprising:

an input of banknotes;

an output of banknotes;

an internal path for sequential flow of banknotes between the input and output;

devices for detecting the characteristics of the banknotes along said internal path;

a plurality of compartments for internal storage of the banknotes, each compartment of the plurality being a sequential drum compartment with winding belts, the compartments of the plurality being divided into two series of compartments having respective compartment inputs/outputs facing each other alternately on two opposite sides of a sorting section of said internal path between the input of banknotes and the output of banknotes, each compartment input/output being associated to sorting means that can be commanded for the deviation of the banknotes between the sorting path and the associated compartment; and wherein the input of banknotes and the output of banknotes are contained in a head part of the machine positioned above a body part of the machine that contains the compartments and said sorting section, the head part and the body part exchanging banknotes through two passages respectively of input of the banknotes into the body part and of output of the banknotes from the body part.

* * * * *